US008308536B2

(12) United States Patent
Kristensson et al.

(10) Patent No.: US 8,308,536 B2
(45) Date of Patent: Nov. 13, 2012

(54) VENTILATING DEVICE FOR PROVIDING A ZONE OF CLEAN AIR

(75) Inventors: Dan Allan Robert Kristensson, Ängelholm (SE); Jan Åke Allan Kristensson, Ängelholm (SE); Pål Martin Svensson, Halmstad (SE)

(73) Assignee: Airsonett Operating Room Innovation AB, Lund (SE)

( * ) Notice: Subject to any disclaimer, the term of this patent is extended or adjusted under 35 U.S.C. 154(b) by 359 days.

(21) Appl. No.: 12/598,427

(22) PCT Filed: Apr. 28, 2008

(86) PCT No.: PCT/SE2008/050483

§ 371 (c)(1),
(2), (4) Date: May 26, 2010

(87) PCT Pub. No.: WO2008/136740

PCT Pub. Date: Nov. 13, 2008

(65) Prior Publication Data

US 2010/0291859 A1 Nov. 18, 2010

(30) Foreign Application Priority Data

May 3, 2007 (SE) ..... 0701074

(51) Int. Cl.
*F24F 13/062* (2006.01)
*F24F 9/00* (2006.01)
*B01L 1/04* (2006.01)

(52) U.S. Cl. ..... 454/284; 454/187; 454/189

(58) Field of Classification Search ..... 454/284, 454/187, 189

See application file for complete search history.

(56) References Cited

U.S. PATENT DOCUMENTS 3,115,819 A * 12/1963 Mahlmeister et al. ..... 454/187

(Continued)

FOREIGN PATENT DOCUMENTS

JP 2006284149 * 10/2006

(Continued)

OTHER PUBLICATIONS

International Search Report for Int'l Application No. PCT/SE2008/050483, Aug. 15, 2008, Swedish Patent Office, Stockholm, Sweden.

(Continued)

*Primary Examiner* — Steven B. McAllister
*Assistant Examiner* — Frances H Kamps
(74) *Attorney, Agent, or Firm* — Stites & Harbison PLLC; Marvin Petry

(57) ABSTRACT

The present invention relates to a ventilating device for providing a zone (1) of clean air between the ventilating device and a workplace region (2), which ventilating device comprises air supply units (3) adapted to generating laminar air flows intended to constitute said clean air zone. The ventilating device comprises at least three air supply units (3) disposed in a closed pattern and air stop and guide units (4) which prevent or hinder air with bacteria-bearing and other pollutant particles which surrounds the clean air zone (1) from being drawn in between the air supply units and into the clean air zone. The air stop and guide units (4) are also configured to guide parts of the air flows from adjoining air supply units (3) outwards from the centre of the clean air zone instead of towards the air supply units, and other parts of the air flows from adjoining air supply units in towards the centre of the clean air zone instead of towards the air supply units, thereby minimizing the increased downward velocity which occurs when the air flows from mutually adjacent air supply units meet in an uncontrolled manner.

20 Claims, 4 Drawing Sheets

U.S. PATENT DOCUMENTS 3,188,936 A * 6/1965 Nordstrom et al. ..... 454/189
3,626,837 A * 12/1971 Pelosi et al. ..... 454/187
3,803,995 A * 4/1974 Allander ..... 454/189
4,137,831 A * 2/1979 Howorth ..... 454/187
4,164,173 A * 8/1979 Douglas ..... 454/299
4,781,108 A * 11/1988 Nillson ..... 454/187
4,890,544 A * 1/1990 Aalto et al. ..... 454/49
4,946,484 A 8/1990 Monson et al.
5,167,577 A * 12/1992 Kristensson ..... 454/298
5,417,610 A 5/1995 Spransy
5,454,756 A 10/1995 Ludwig
5,716,268 A * 2/1998 Strongin et al. ..... 454/66
5,830,058 A * 11/1998 Røsjø ..... 454/187
5,904,896 A * 5/1999 High ..... 422/4
7,022,010 B1 * 4/2006 Cardon ..... 454/292
7,297,050 B2 * 11/2007 Bridenne et al. ..... 454/187
7,462,213 B2 * 12/2008 Spengler ..... 55/385.2
7,645,188 B1 * 1/2010 Peerbolt ..... 454/296
2006/0003684 A1 1/2006 Hwang et al.
2006/0252364 A1 11/2006 Kristenson et al.
2007/0089383 A1 4/2007 Spengler

FOREIGN PATENT DOCUMENTS

WO WO-2008/004925 1/2008

OTHER PUBLICATIONS

International Preliminary Report on Patentability issued Nov. 3, 2009 with Written Opinion of the International Searching Authority mailed Aug. 15, 2008 for Int'l Application No. PCT/SE2008/050483, Swedish Patent Office, Stockholm, Sweden.

* cited by examiner

VENTILATING DEVICE FOR PROVIDING A ZONE OF CLEAN AIR

BACKGROUND TO THE INVENTION

The present invention relates to a ventilating device for providing a zone of clean air between the ventilating device and a workplace region, which ventilating device comprises air supply units adapted to generating laminar air flows intended to constitute said clean air zone.

BRIEF SUMMARY OF THE INVENTION

The object of a ventilating device as above is to create a uniform and stable downward air flow which prevents bacteria-bearing and other pollutant particles from entering the workplace region from the surrounding environment and carries away pollutants generated within the clean air zone.

The state of the art is based on blowing vertically downwards to provide the workplace region, e.g. an operating region, with an air flow velocity of 0.1-0.6 m/s. Achieving this entails a high initial air velocity of at least double, resulting in disturbing effects, e.g. turbulence, arising from, for example, operating lighting or other equipment situated between the ventilating device and the workplace region. The high air velocity also creates strong secondary air flows outside the workplace region which keep bacteria-bearing and other particles suspended, increasing the risk of contamination of the workplace region. High air velocity also subjects personnel to draughts and high noise levels.

The present invention is characterised inter glia by placing a number of preferably conventional air supply units in a closed pattern, e.g. in a circle, so that a widely spread uniform and stable downward combined air flow is created. These air supply units are of a unique configuration whereby the initial outlet velocity of the air flows from them persists for only a few decimetres and downward flow thereafter is totally dependent on lower temperature.

The disadvantage of air supply units in a closed pattern, e.g. in a circle, is that a slight negative pressure is created in the centre of the circle and exerts a suction force which draws bacteria-bearing and other pollutant particles in between the respective air supply units and into the clean air zone in the lower portion of the workplace region.

To prevent or at least hinder this, the present invention is also characterised by specially configured air stop and guide units disposed between, and filling the spaces between, the air supply units via which air might be drawn into the clean air zone.

Said air stop and guide units also help to minimize the increased downward velocity which occurs when the air flows from mutually adjacent air supply units meet in an uncontrolled manner. This is because the air stop and guide units according to the invention are so configured that they guide parts of the air flows from adjoining air supply units outwards from the centre of the clean air zone instead of towards the air supply units, and other parts of the air flows from adjoining air supply units in towards the centre of the clean air zone instead of towards the air supply units. This means that the points where the air flows from two adjoining air supply units meet are almost free from turbulence and that the air flows are instead caused to cooperate in a uniform and turbulence-free downward air flow.

The ventilating device according to the present invention functions accordingly in the same advantageous way as an individual air supply unit but serves a significantly larger region.

Other objects and advantages of the invention will be apparent to one skilled in the art who examines the attached drawings and the detailed description set out below of preferred embodiments.

DETAILED DESCRIPTION OF PREFERRED EMBODIMENTS OF THE INVENTION

Figure 1:
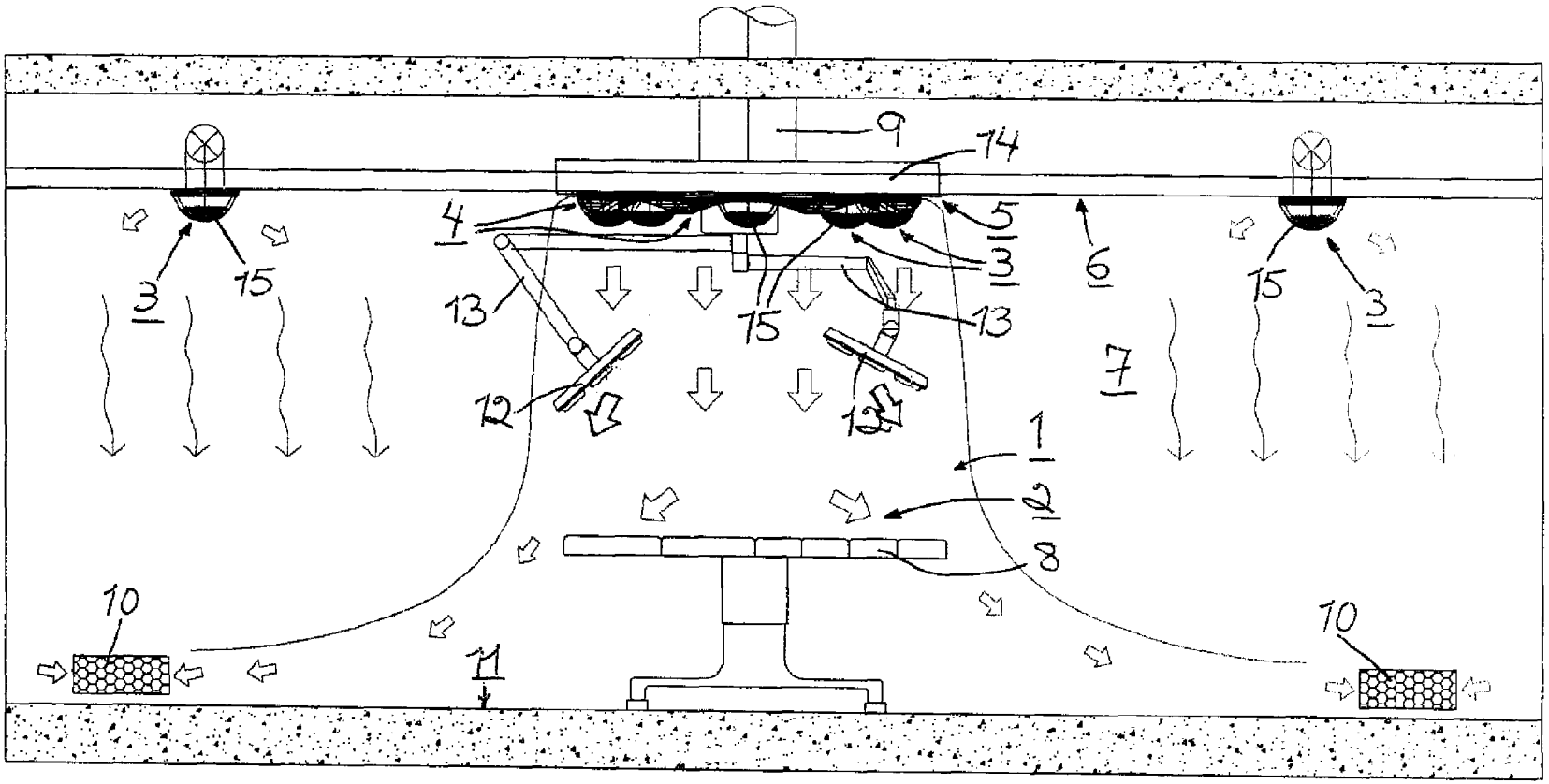
FIG. 1 is a schematic side view of a ventilating device according to the invention and the air flows generated by it.

The ventilating device according to FIG. 1 is intended to create a zone 1 of clean air between the ventilating device and a workplace region, here an operating region 2 in the healthcare sector. The ventilating device comprises air supply units 3 which may be of a conventional type and are adapted to generating laminar air flows intended to constitute said clean air zone 1.

With the object of achieving, as compared with each individual air supply unit 3, a total air flow with a significantly greater spread which therefore serves a significantly larger region within which personnel have more freedom of movement for their work, the ventilating device according to the invention comprises at least three air supply units 3 disposed in a closed trilateral pattern of three air supply units. The result is that the clean air zone 1 has below the air supply units 3 an extent which in cross-section substantially corresponds to the surface delineated by said closed pattern of air supply units and the surface situated within that pattern, i.e. substantially the extent indicated by FIG. 1.

To prevent or hinder air surrounding the clean air zone 1 and containing bacteria-bearing and other pollutant particles from being drawn in between the air supply units and into the clean air zone by the negative pressure and consequent suction force generated in the clean air zone by the air flows of the mutually adjacent air supply units 3, the ventilating device according to the invention comprises in addition a corresponding number of, i.e. at least three, air stop and guide units 4 disposed between the respective pairs of mutually adjacent air supply units.

As well as being trilateral or circular as indicated above, the closed pattern of air supply units 3 may also be, for example, elliptical, square, rectangular or have five, six or more sides or a combination of different shapes. In such cases, the air stop and guide units 4 are suitably disposed in corresponding patterns in the spaces delineated between mutually adjacent air supply units 3. Each air stop and guide unit 4 will with advantage also fill the whole space between two mutually adjacent air supply units 3.

The number of air supply units 3 and the number of air stop and guide units 4 disposed between them each amount preferably to between 3 and 15, depending on the desired extent of the region to be served by the ventilating device. In the preferred version depicted in the drawings, the number of air supply units 3 and air stop and guide units 4 is eight (8) each.

The air supply units 3 and the air stop and guide units 4 disposed between them in the version depicted are mounted on a container 5. The container 5 is fitted permanently in the ceiling of the room in which the workplace region is situated, i.e. here in the ceiling 6 of the operating room 7 in which the operating region 2 defining or constituting the operating table 8 is situated.

The container 5 comprises with advantage, or is connected via an air duct 9 to, at least one air intake for taking air in from the room 7 and/or from at least one location outside said room. Thus, for example, some of the air drawn out of the room 7 via air extracts 10 at or near the floor 11 of the room may be led back to the air supply units 3 in the ventilating device. Air may also be brought from air intakes (not depicted) in or near the ceiling 6 of the room 7.

The container 5 comprises with advantage, or is likewise connected via preferably the same air duct 9 to, a fan device (not depicted) for supplying air and causing it to flow through the air supply units 3.

Correspondingly, the container 5 comprises, or is connected preferably via same air duct 9 to, an air treatment device for generating clean air for the clean air zone 1. The air treatment device comprises in a simple version at least one filter device (not depicted) for filtering the air to the air supply units 3 so that the air will be clean and can constitute said clean air zone 1, and also a device (not depicted) for cooling of air from the filter device to a lower temperature than the temperature of the air in the room 7, so that clean air intended to constitute the clean air zone will be at such a lower temperature, e.g. 1-2° C. lower, than air surrounding the clean air zone that clean air in the clean air zone sinks slowly downwards towards the workplace region, here the operating region 2. The higher density of the cooler air is thus used for controlling the downward velocity. The advantage of this is that the initial air velocity a few decimetres from the air supply units need not be greater than the air velocity required down at the workplace region for creating a sufficient velocity therein. Less disturbing effects, turbulence, and secondary air flows outside the workplace region are thereby generated, resulting in less risk of contamination of the workplace region. Low air velocity results in small air flow with high efficiency and, for personnel, a draught-free and quiet work environment.

The level of the preferably constant lower temperature of the air in the clean air zone 1 relative to surrounding air in the room 7 is with advantage maintained by a regulating device (not depicted) which forms part of the ventilating device and which therefore regulates the temperature of the clean air in the clean air zone in order to regulate the velocity of the clean air in the clean air zone. To this end, the regulating device is controlled by temperature sensors of a suitable type (not depicted) situated with advantage in the container 14 or in the air flow before 9 and level with the operating table 8 in the operating room 7.

The air supply units 3 and the air stop and guide units 4 disposed between them are preferably fitted at or in the vicinity of the outer periphery of the container 5 if the shape of the container is different from the closed pattern which said air supply units and air stop and guide units form.

As depicted in FIG. 1, a lighting device with one or more lamps 12 suspended in arms 13 may be situated close to the container 5.

In the depicted preferred version, the container 5 takes the form of a container 14 with the air supply units 3 and the air stop and guide units 4 disposed between them fitted on the underside of the container. The container 14 is here circular with a diameter of about 1 to 4 m. The closed circular pattern of air supply units 3 and air stop and guide units 4 runs along and close to the outer periphery of the container 14.

The respective air supply units 3 in the ventilating device may be of the type described in, for example, PCT/SE2004/001182. Thus the respective air supply units 3 as seen from the side may preferably be of at least partly hemispherical or substantially hemispherical shape, resulting in a distinct clean air zone with a distinctly limited extent from each air supply unit. The respective air supply units 3 also preferably present a substantially circular cross-section. Each air supply unit 3 has a body 15 made of foam plastic or similar porous material or fabric adapted to generating laminar air flows, thereby minimizing the risk of air surrounding the clean air zone 1 entering the clean air zone. The body 15 may comprise an inner element and an outer element, the inner element imparting to air flowing through a greater pressure drop than the outer element. The inner element may be made of foam plastic or other porous material or fabric, while the outer element takes the form of, for example, tubular throughflow ducts. The length of these throughflow ducts is with advantage 4-10 times greater than their width, to ensure that the turbulence in at least an outer portion of the clean air zone 1 will be as little as possible. Other suitable types of air supply units with desired suitable functions may nevertheless be used in the ventilating device according to the present invention.

The form of the respective air stop and guide units 4 will be appropriate to the desired function. In the version depicted, each air stop and guide unit 4 comprises accordingly at least one air stop surface 16 which faces away from the clean air zone 1 and prevents or hinders air surrounding the clean air zone from being drawn in between adjoining air supply units 3 and into the clean air zone. Each air stop and guide unit 4 also comprises at least two first air guide surfaces 17 which run from the air stop surface 16 in between adjoining air supply units 3, converge towards one another and guide away from one another and out from the centre of the clean air zone 1 parts of the respective air flows directed towards one another from adjoining air supply units. Each air stop and guide unit 4 also comprises at least two second air guide surfaces 18 which face inwards towards the centre of the clean air zone 1 and towards said first air guide surfaces 17, converge towards one another and guide away from one another and inwards towards the centre of the clean air zone parts of the air flows directed towards one another from adjoining air supply units 3. This preferred version of the air stop and guide units 4 achieves the least possible turbulence between the air flows meeting between the air supply units 3 and prevents bacteria-bearing and other pollutant particles from being drawn into the clean air zone 1.

As the respective air supply units 3 in the preferred version depicted are substantially circular in shape, the respective air stop and guide units 4, especially their first air guide surfaces 17, run here along at least about 90° of the periphery of adjoining air supply units.

The air stop surface 16 on the air stop and guide units 4 has with advantage a configuration which in at least a cross-sectional plane through said surface and through the air supply units 3 coincides with the configuration of a line which links the outermost portions of the air supply units as seen from the clean air zone 1. In the preferred version depicted with the air supply units 3 disposed in a circle, the air stop surface 16 has accordingly a curvature which in said cross-sectional plane coincides with the curvature of a circular line which runs through the radially outermost portions of the air supply units (see FIG. 3). The air stop surface 16 is also preferably of such a length that it runs from the vicinity of the outermost portions of one of the two mutually adjacent air supply units 3 between which the respective air stop and guide unit 4 is disposed, to the vicinity of the outermost portions of the other of the two air supply units. This contributes to optimum filling of the space between each pair of mutually adjacent air supply units 3.

Figure 2:
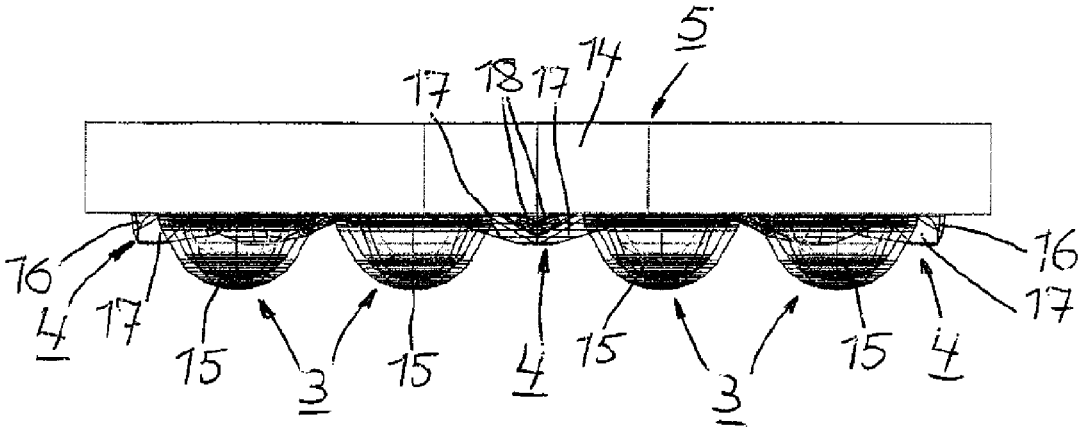
FIG. 2 is a somewhat enlarged side view of a container with air supply units, and with air stop and guide units disposed between the air supply units, for the ventilating device according to FIG. 1.
Figure 3:
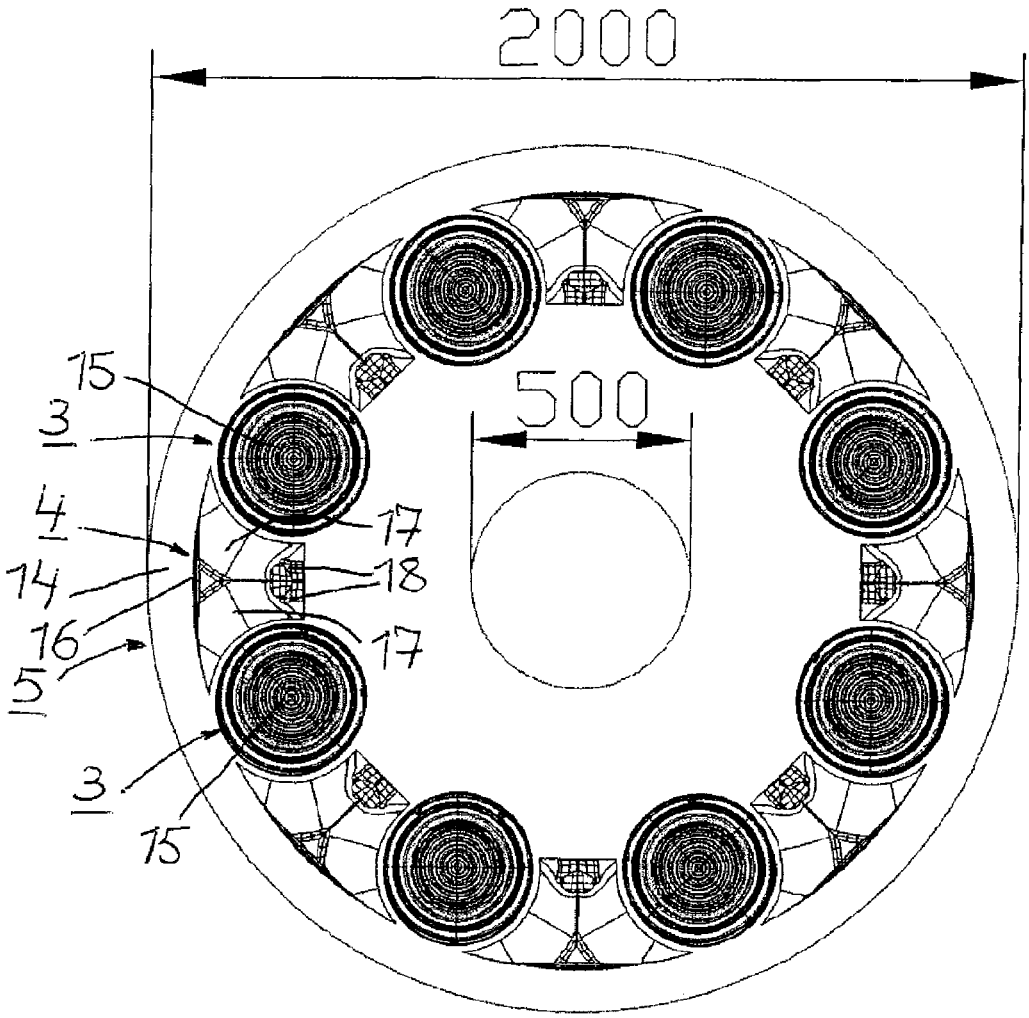
FIG. 3 is a plan view of the container with the air supply units and the air stop and guide units according to FIG. 2.

The first air guide surfaces 17 on the respective air stop and guide unit 4 as seen in a cross-sectional plane converge towards one another preferably in a manner corresponding to the cross-sectional shape of adjoining air supply units 3, i.e. said surfaces run towards one another inwards towards the centre of the clean air zone 1 and have accordingly the same configuration as adjoining air supply units so that the distance between the first air guide surfaces and the air supply units is constant (see FIG. 3). The first air guide surfaces 17 as seen in a longitudinal sectional plane also converge towards one another, i.e. said surfaces run towards one another downwards to the workplace region 2 in the clean air zone 1 (see FIGS. 2 and 4).

Figure 4:
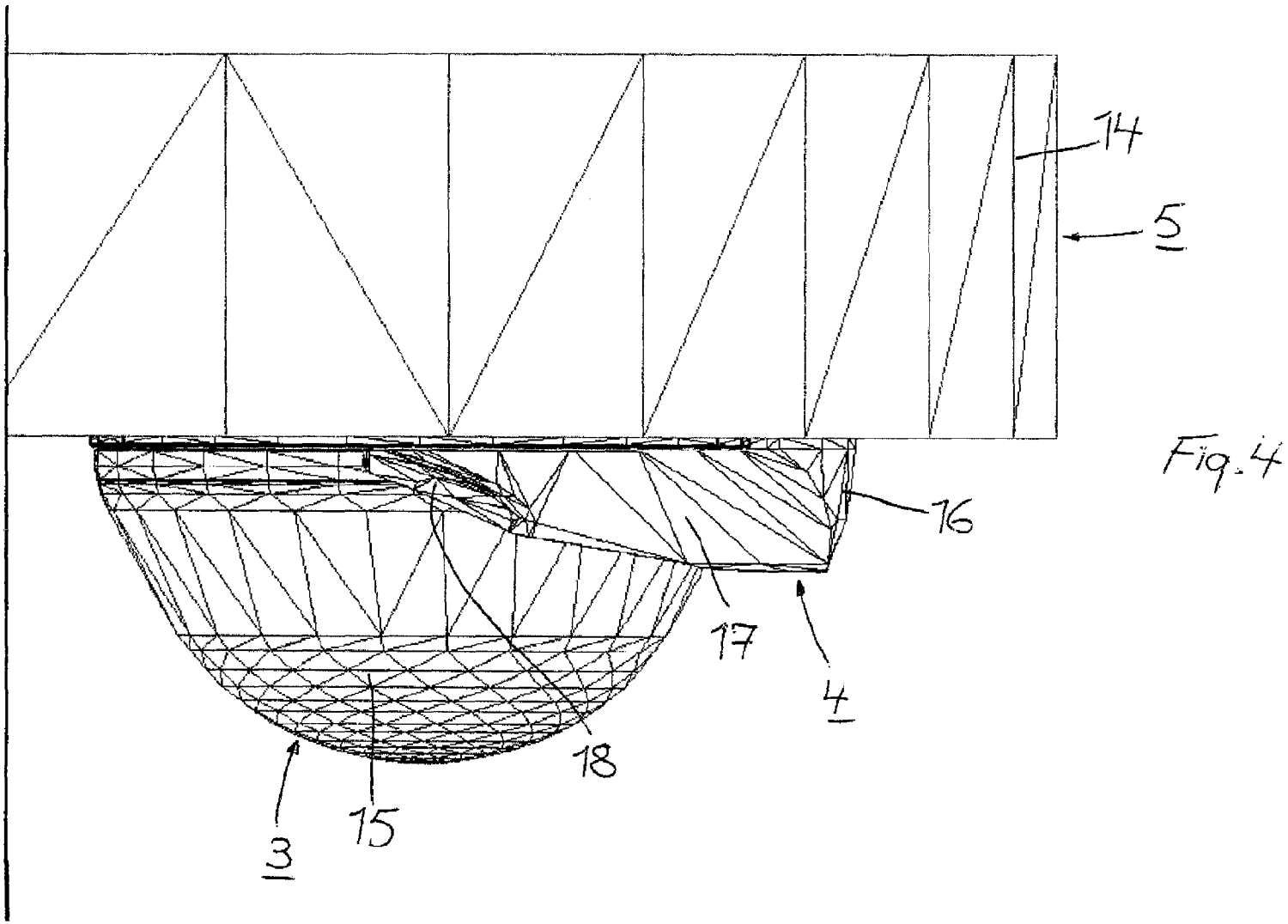
FIG. 4 is an enlarged side view of part of FIG. 2.

Finally, the second air guide surfaces 18 run, as above, towards the first air guide surfaces 17 outwards from the centre of the clean air zone 1 and downwards towards the workplace region in the clean air zone (see FIGS. 2-4). They also run towards one another downwards towards said workplace region (see FIGS. 2 and 4).

With the object of also controlling the level of bacteria-bearing and other pollutant particles outside the clean air zone 1/the workplace region 2 and preventing or hindering any occurrence of "whirlpools" of secondary air flows holding such particles in suspension, it is advantageous if air is also supplied in a controlled manner outside the clean air zone. To this end, according to the invention, at least one further air supply unit 3 of preferably the type described above is disposed in the room 7 to supply air to the room. This air maintains with advantage a temperature exceeding the temperature of the air in the clean air zone 1, thereby compensating in particular for the cooling effect caused by the clean air zone 1. In the preferred version depicted, a plurality of further air supply units 3 are disposed all round the first-mentioned air supply units 3 and said air stop and guide units 4 (on the container 5) in the room 7 to supply the room round the clean air zone with somewhat warmer air than the air in the clean air zone 1. Said further air supply units 3 have their own, or are suitably connected at least to the aforesaid, fan and filter devices.

The ventilating device according to the invention comprises a regulating device (not depicted) for regulating the temperature of the air which is supplied to the room 7 and caused to surround the clean air zone 1, and/or for regulating the velocity of the air which is supplied to the room and is caused to surround the clean air zone. The temperature of the whole room 7 can thereby be regulated. The regulating device is controlled by temperature sensors (not depicted) situated in the room 7 outside the clean air zone 1.

It will be obvious to one skilled in the art that the ventilating device according to the present invention can be modified and altered within the scope of the claims set out below without departing from the idea and object of the invention. Thus, for example, said fan, filter and cooling devices may be configured and disposed in any manner appropriate to the purpose, as also may said regulating devices. The number, type and shape of the air supply units and of the air stop and guide units may vary beyond what is indicated above, as also may how they are positioned relative to one another and how they are positioned on the container for the ventilating device. The shape of the container may also vary beyond what is indicated above and may also, as previously indicated, follow or not follow the closed pattern constituted by the air supply units and the air stop and guide units.

The invention claimed is:

1. A ventilating device for providing in a room a zone of clean air between the ventilating device and a workplace region in the room, which ventilating device comprises air supply units adapted to generating laminar air flows intended to constitute said clean air zone, wherein the ventilating device comprises at least three air supply units disposed in a closed pattern so that the extent in cross-section of the clean air zone below the air supply units substantially corresponds to the surface delineated by said closed pattern of air supply units and the surface situated within that pattern, and a corresponding number of air stop and guide units disposed between, and substantially filling the space between each pair of mutually adjacent air supply units, each air stop and guide unit having at least one air stop surface which faces outwards away from the clean air zone and prevents or hinders air surrounding the clean air zone from being drawn in between adjoining air supply units and into the clean air zone, at least two first air guide surfaces which run from the air stop surface in between adjoining air supply units, converge towards one another and guide parts of the air flows from adjoining air supply units that are directed towards one another away from one another and outwards from the centre of the clean air zone, and at least two second air guide surfaces which face inwards towards the centre of the clean air zone and converge towards said first air guide surfaces and towards one another and guide other parts of the air flows from adjoining air supply units that are directed towards one another away from one another and inwards towards the centre of the clean air zone.

2. A ventilating device according to claim 1, wherein the air supply units are disposed in a pattern which is circular, elliptical or has three, four, five or more sides or combinations thereof, with the air stop and guide units in a corresponding pattern in the spaces delineated between mutually adjacent air supply units.

3. A ventilating device according to claim 1, wherein the number of air supply units and the number of air stop and guide units disposed between them are between 3 and 15 each, preferably 8.

4. A ventilating device according to claim 1, wherein the air supply units and the air stop guide units disposed between them are mounted on a common container is fitted permanently in the ceiling of the room in which said workplace region is situated.

5. A ventilating device according to claim 1, wherein the container comprises, or is connected via an air duct to, an air treatment device which comprises at least a filter device for filtering air in order to provide clean air intended to constitute said clean air zone, and a device for cooling of air to a lower temperature than the temperature of the air in the room in which said workplace region is situated, in order to allow clean air intended to constitute the clean air zone to be at such a lower temperature than air surrounding the clean air zone than clean air in the clean air zone sinks slowly downwards towards the workplace region.

6. A ventilating device according to claim 1, wherein the air supply units and the air stop and guide units disposed between them are fitted at or in the vicinity of the outer periphery of the container.

7. A ventilating device according to claim 1, wherein the container takes the form of a container with the air supply units and the air stop and guide units disposed between them fitted on the underside of the container.

8. A ventilating device according to claim 7, wherein the container is circular and has a diameter of about 1 to 4 m.

9. A ventilating device according to claim 1, wherein the respective air supply units have an at least partly hemispherical or substantially hemispherical longitudinal section.

10. A ventilating device according to claim 1, wherein the respective air supply units have a substantially circular cross-section.

11. A ventilating device according to claim 1, wherein the respective air supply units have at least a body made of foam plastic or corresponding porous material or fabric and adapted to generating laminar air flows.

12. A ventilating device according to claim 1, wherein the respective air supply units have at least a body with an inner element and an outer element and that the inner element imparts to air flowing through a greater pressure drop than the outer element.

13. A ventilating device according to claim 1, wherein the respective air supply units have at least a body with an inner element made of foam plastic or other porous material or fabric, and with an outer element made of tubular throughflow ducts, the lengths of which are 4-10 times greater than their widths to ensure that the turbulence in at least an outer portion of the clean air zone will be as little as possible.

14. A ventilating device according to claim 1, wherein the respective air supply units have a substantially circular cross-section and that the respective air stop and guide units run along at least about 90° of the periphery of the adjoining air supply units.

15. A ventilating device according to claim 1, wherein the air stop surface has an extent which in at least one cross-sectional plane coincides with the extent of a line linking the outermost portions of the air supply units as seen from the clean air zone.

16. A ventilating device according to claim 15, wherein the air supply units are disposed in a circle and that the air stop surface has a curvature which in at least a cross-sectional plane coincides with the curvature of a circular line running through the radially outermost portions of the air supply units.

17. A ventilating device according to claim 15, wherein the air stop surface runs from the vicinity of the outermost portions of one of the two mutually adjacent air supply units between which the respective air stop and guide unit is disposed to the vicinity of the outermost portions of the other of the two air supply units.

18. A ventilating device according to claim 1, wherein said first air guide surfaces as seen in a cross-sectional plane converge towards one another in a manner corresponding to the cross-sectional shape of adjoining air supply units.

19. A ventilating device according to claim 1, wherein said first air guide surfaces in a longitudinal sectional plane converge towards one another.

20. A ventilating device according to claim 1, wherein the container has an air extract situated centrally and running at the lower portion of the ventilating device for extracting air from the workplace region.

* * * * *